US009441884B2

(12) United States Patent
McCallum et al.

(10) Patent No.: US 9,441,884 B2
(45) Date of Patent: Sep. 13, 2016

(54) METHOD AND APPARATUS FOR AUTOMATICALLY DRYING WET FLOORS

(71) Applicant: Norgren Automation Solutions, LLC, Saline, MI (US)

(72) Inventors: Scott R. McCallum, St. Clair, MI (US); Timothy John Key, Onsted, MI (US); James R. Kalb, Petersburg, MI (US); Richard Daniel Koski, Saline, MI (US); John D. Begin, Chesterfield Township, MI (US)

(73) Assignee: Norgren Automation Solutions, LLC, Saline, MI (US)

( * ) Notice: Subject to any disclaimer, the term of this patent is extended or adjusted under 35 U.S.C. 154(b) by 527 days.

(21) Appl. No.: 13/891,868

(22) Filed: May 10, 2013

(65) Prior Publication Data

US 2013/0298421 A1 Nov. 14, 2013

Related U.S. Application Data

(60) Provisional application No. 61/645,162, filed on May 10, 2012.

(51) Int. Cl.

| | |
|---|---|
| ***F26B 21/12*** | (2006.01) |
| ***F26B 21/02*** | (2006.01) |
| ***F26B 9/02*** | (2006.01) |
| ***F26B 25/22*** | (2006.01) |
| ***F26B 21/00*** | (2006.01) |

(52) U.S. Cl.

CPC ..... *F26B 21/12* (2013.01); *F26B 9/02* (2013.01); *F26B 21/001* (2013.01); *F26B 21/022* (2013.01); *F26B 21/028* (2013.01); *F26B 25/22* (2013.01)

(58) Field of Classification Search

CPC .. F26B 21/001; F26B 21/022; F26B 21/028; F26B 21/12; F26B 25/22; F26B 9/02

See application file for complete search history.

(56) References Cited

U.S. PATENT DOCUMENTS 1,776,992 A * 9/1930 Brockman ..... H01H 3/141 200/4
3,758,959 A * 9/1973 Karklys ..... D06F 58/28 34/533

(Continued)

FOREIGN PATENT DOCUMENTS

EP 2 278 242 A1 1/2011
EP 2278242 A1 1/2011

OTHER PUBLICATIONS

International Search Report and Written Opinion, PCT/US2013/040595, mailed Aug. 7, 2013.

*Primary Examiner* — Kenneth Rinehart
*Assistant Examiner* — Logan Jones
(74) *Attorney, Agent, or Firm* — Young Basile Hanlon & MacFarlane P.C.

(57) ABSTRACT

An apparatus for automatically drying wet floors includes a controller, a moisture detector that is operable to detect the presence of moisture at a first location and transmit a moisture detection signal to the controller in response to detecting the presence of moisture at the first location, and a blower. The blower is operative to turn on and off for drying the wet floors by directing moving air toward the first location in response to an operating signal from the controller. The controller outputs the operating signal to the blower based on the moisture detection signal.

10 Claims, 6 Drawing Sheets

(56) References Cited

U.S. PATENT DOCUMENTS 4,133,072 A 1/1979 Face, Jr.
4,145,821 A * 3/1979 Schantz ..... F26B 21/001 34/237
4,227,190 A * 10/1980 Kelley ..... G01N 27/048 340/604
4,538,141 A 8/1985 Feldman
4,571,849 A 2/1986 Gardner et al.
4,942,364 A * 7/1990 Nishijima ..... G01N 27/121 324/694
5,048,202 A * 9/1991 Shero ..... F26B 21/001 34/618
5,068,642 A * 11/1991 Hruby ..... G08B 13/26 340/562
5,257,159 A 10/1993 Wallace et al.
5,317,476 A 5/1994 Wallace et al.
5,566,471 A 10/1996 Hirano
6,104,298 A 8/2000 Flanders
6,615,508 B1 * 9/2003 Valle ..... E04B 1/7092 34/201
6,639,517 B1 * 10/2003 Chapman ..... G01M 3/16 137/312
6,995,676 B2 2/2006 Amacher
7,142,123 B1 11/2006 Kates
7,173,538 B2 * 2/2007 Pedraza ..... E04B 1/70 34/418
7,292,155 B2 11/2007 Vokey et al.
7,561,057 B2 * 7/2009 Kates ..... G01M 3/002 340/605
7,583,198 B2 9/2009 Kates
7,688,215 B2 3/2010 Vokey et al.
7,768,412 B2 8/2010 Vokey
7,948,388 B2 * 5/2011 McGinty ..... G08B 21/20 137/15.11
7,956,760 B2 6/2011 Hill
8,236,164 B2 * 8/2012 Gustafsson ..... G01N 27/223 204/430
8,356,450 B2 1/2013 Larimore
8,416,089 B1 4/2013 Clary
8,499,472 B2 * 8/2013 Bari ..... D06F 58/16 219/211
2002/0113713 A1 * 8/2002 Palmer ..... G08B 21/08 340/605
2002/0160144 A1 * 10/2002 Higgins ..... A47G 27/0475 428/95
2003/0011482 A1 * 1/2003 Harms ..... G08B 21/20 340/605
2003/0115783 A1 6/2003 Woosley
2004/0194546 A1 * 10/2004 Kanehori ..... G01N 27/225 73/335.04
2004/0216269 A1 11/2004 Slawinski
2005/0144801 A1 7/2005 Wilson
2006/0087428 A1 4/2006 Wolfe et al.
2006/0143936 A1 7/2006 Studebaker
2006/0191324 A1 8/2006 Garabedian et al.
2006/0244616 A1 11/2006 Hill
2006/0286922 A1 12/2006 Roux et al.
2007/0022939 A1 2/2007 Stokes, IV
2007/0157485 A1 7/2007 Andrisin, III et al.
2007/0234502 A1 * 10/2007 Brobeck ..... A47L 11/292 15/319
2007/0276626 A1 11/2007 Bruffey
2008/0053197 A1 3/2008 McGinty et al.
2008/0271338 A1 11/2008 Muir et al.
2009/0133280 A1 5/2009 Wichern
2009/0320556 A1 12/2009 Collins et al.
2010/0083522 A1 4/2010 Tritz
2010/0271212 A1 * 10/2010 Page ..... A61B 5/4216 340/573.1
2010/0282859 A1 * 11/2010 Helbig ..... A01G 25/06 239/11
2011/0302720 A1 * 12/2011 Yakam ..... A61B 5/1115 5/710
2012/0017478 A1 1/2012 Stephenson
2012/0042536 A1 2/2012 White
2013/0113505 A1 * 5/2013 Pfeiffer ..... G01N 27/126 324/694
2014/0375451 A1 * 12/2014 Douglas ..... H04W 4/14 340/539.12

* cited by examiner

METHOD AND APPARATUS FOR AUTOMATICALLY DRYING WET FLOORS

CROSS-REFERENCE TO RELATED APPLICATIONS

This application claims priority to U.S. Provisional Patent Application Ser. No. 61/645,162, which was filed on May 10, 2012.

TECHNICAL FIELD

The disclosure herein relates to a method and apparatus for automatically drying wet floors, and more particularly, a method and apparatus that automatically dries wet floors made wet by pedestrians walking into a building from outside the building during wet weather conditions.

BACKGROUND

The problem of wet floors caused by pedestrians tracking water into buildings during rainy or snowy weather conditions has existed as long as people have inhabited buildings. Water or snow tracked onto interior floors is not only unsightly, but it can represent a safety hazard, thereby creating a liability for businesses and homeowners. Traditional techniques for dealing with wet floors include placing rugs or mats near entranceways to absorb water being tracked into a building. The disadvantages to this approach include having to replace or clean the rugs or mats on a regular basis, thereby incurring material and labor costs. In addition, water from the rugs or mats can still be tracked onto the floors beyond the placement of the rugs or mats, as pedestrians walk onto the wet rugs or mats and track the water onto the floor of the building.

Another technique for drying floors includes manually positioning fans or blowers to dry the floor of a building when it is observed that the floor is wet. The disadvantage of this approach is that it requires labor to observe the wet floor and manually move the fans or blowers into position while also removing the fans or blowers when the floor is dry.

SUMMARY

Methods and apparatuses for automatically drying wet floors are disclosed herein.

One aspect of the disclosed embodiments is an apparatus for automatically drying wet floors that includes a controller, a moisture detector, and a blower. The moisture detector is operable to detect the presence of moisture at a first location and transmit a moisture detection signal to the controller in response to detecting the presence of moisture at the first location. The blower is operative to turn on and off for drying the wet floors by directing moving air toward the first location in response to an operating signal from the controller. The controller outputs the operating signal to the blower based on the moisture detection signal.

Another aspect of the disclosed embodiments is an apparatus for automatically drying wet floors that includes a controller, a floor mat, and a blower. The floor mat includes a carpet layer that includes carpet fibers that define a carpet surface. The floor mat also includes an impermeable and non-conductive carpet backing layer that has a top surface and a bottom surface. The top surface of the covered backing layer has the carpet fibers affixed thereto. The floor mat also includes a first electrode assembly that has a first conductor portion that is disposed adjacent to the bottom surface of the carpet backing layer and a plurality of first electrodes. The first electrodes are electrically connected to the first conductor portion, extend through the carpet backing layer, and are disposed within the carpet layer. The floor mat also includes a second electrode assembly that has a second conductor portion that is disposed adjacent to the bottom surface of the carpet backing layer and a plurality of second electrodes. The second electrodes are electrically connected to the second conductor portion, extend through the carpet backing layer, and are disposed within the carpet layer. The floor mat also includes a control circuit for transmitting a moisture detection signal to the controller by wireless communication with the controller in response to a completed electrical circuit that includes electrical communication between the first electrode assembly and the second electrode assembly via a wetted portion of the carpet layer. The blower is operable to turn on and off for drying the wet floors by directing moving air toward the floor mat in response to an operating signal from the controller. The controller outputs the operating signal to the blower based on the moisture detection signal.

Another aspect of the disclosed embodiments is a method for automatically drying wet floors that includes detecting the presence of moisture by a moisture detector at a first location; transmitting a moisture detection signal from the moisture detector to a controller in response to detecting the presence of moisture at the first location; outputting an operating signal from the controller to a blower based on the moisture detection signal if an operating condition is satisfied; and operating the blower in response to the operating signal.

DETAILED DESCRIPTION

The description herein is directed to methods and apparatuses for automatically drying wet floors of a building. The examples herein include apparatuses that detect conditions that may give rise to water being tracked onto floors of a building or may detect the water as the water is actually being tracked onto the floors of the building. In some examples, a sensor is mounted outside of a building near an entranceway of the building for detecting conditions that may result in water being tracked into the building, such as rain, snow, and/or hail. In other examples, the water being tracked into the building may be detected by sensors inside the building, such as sensors on a rug or mat lying on the floor of the building, or a machine vision system that is operable to capture images of an area inside the building and determine if water is present in the area. Upon detecting conditions that could cause water to be tracked onto the floor of the building, or upon detecting the tracked water on the floor of the building, signals can be sent to warning devices that alert pedestrians of a potential hazard in the vicinity of the tracked water on the floor of the building.

In some examples, when tracked water or conditions that can lead to tracked water on the floor of the building are sensed, a drying device is operated in response to the signals indicating the presence of tracked water. As examples, the drying device can be a blower or fan, which is placed into operation to begin drying the tracked water on the floor of the building. In implementations where sensors are utilized to detect the tracked water within the building, the sensors detect a change in the presence of moisture during the drying process and signal the blower, fan, or other drying device to stop operating when the tracked water has been substantially removed from the floor of the building. The sensors can include video cameras connected to controllers that visually detect tracked water using image processing techniques, or the mats with sensors can be utilized for detecting moisture. The sensors, warning devices, and drying devices can be connected to a controller that inputs data from the sensors and outputs signals to control the warning devices and the drying devices.

Figure 1:
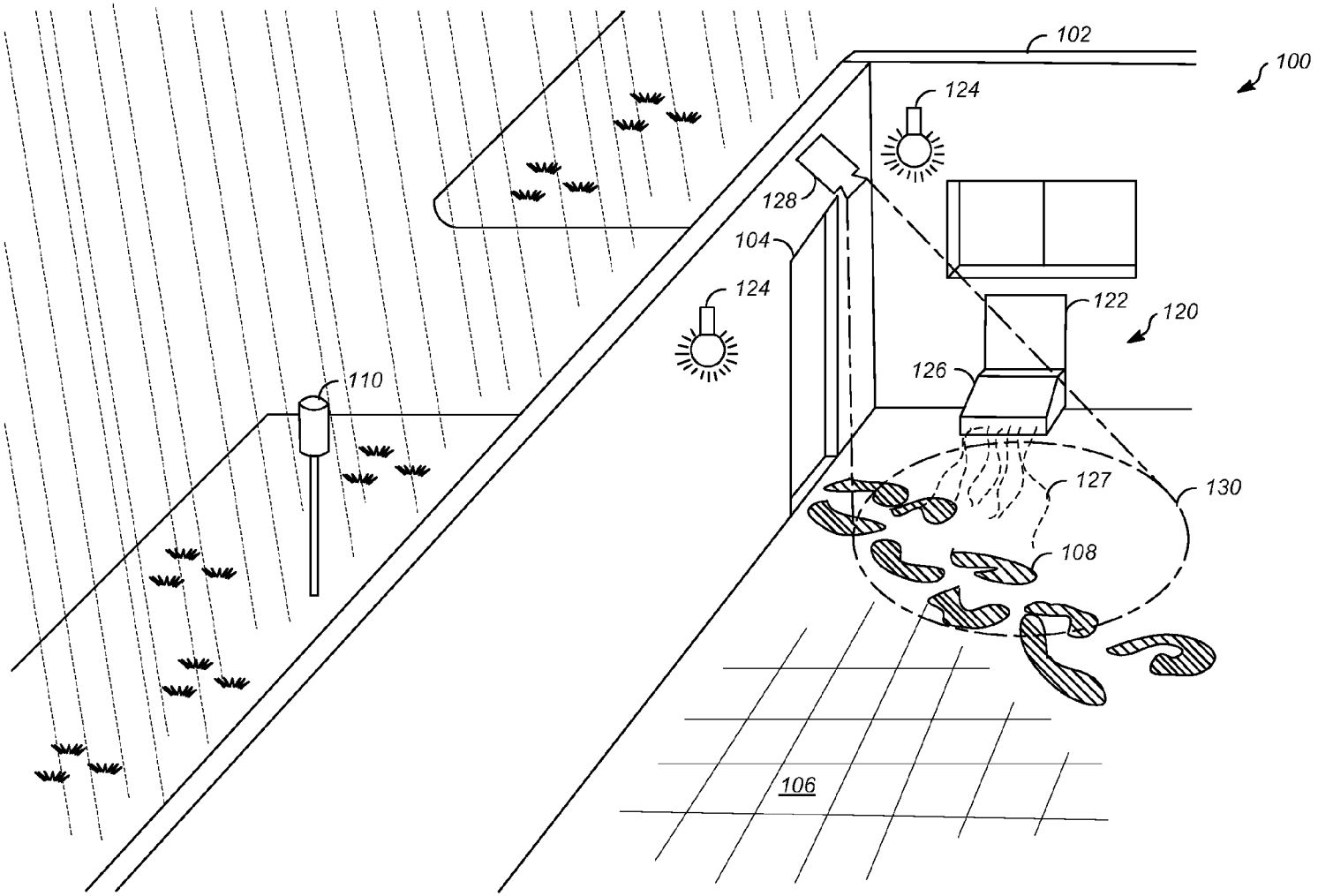
FIG. 1 is a perspective schematic diagram of a first example apparatus for automatically drying wet floors.

FIG. 1 shows a first example apparatus 100 for automatically drying wet floors of a building. The first example apparatus 100 is installed in a building 102 having an entranceway 104 and a floor 106. A moisture detector in the form of a wet weather sensor 110 may be installed at a location that is outside of the building 102 where the wet weather sensor 110 has access to the weather elements, such as on the roof of the building 102. The wet weather sensor 110 may be any type of sensor, including electrical or optical, that detects weather conditions that could lead to water being tracked into the building 102, including rain, snow, and/or hail, for example. The weather condition detected by the wet weather sensor 110 may be referred to herein as a sensed weather condition.

When the wet weather sensor 110 detects wet weather, the wet weather sensor 110 sends a moisture detection signal to a drying system 120. The drying system 120 may include a controller 122 that receives the moisture detection signal from the wet weather sensor 110 and makes a decision, based on hardware or software, whether to send warning control signals to warning devices 124. The warning devices 124 can be or include illuminated warning indicators such as flashing yellow lights or illuminated signs that are mounted to the inside walls of the building 102 to warn pedestrians that potential tracked water 108 may exist on the floor 106 of the building 102 thereby creating a potentially hazardous condition. The warning devices 124 can turn on and turn off in response to the warning control signals.

The controller 122 can also output an operating signal to a drying device such as an electric blower 126 that is mounted to an inner wall and/or the floor 106 of the building 102. The electric blower 126 is operable to direct rapidly moving air 127 across the floor 106 of the building 102 to begin drying the tracked water 108. The electric blower 126 may also contain a heating element (not shown) built therein so that the electric blower 126 blows warm or hot air across the floor 106 of the building 102 so as to decrease the time associated with drying the floor 106.

In order to detect the condition of the floor 106 in the building 102, a moisture detector can be provided in the form of a vision system, which may include a video camera 128. The video camera 128 can be mounted to an inner wall of the building 102 such that the video camera 128 has a field of view 130 that encompasses a first location, such as an area of the floor 106 that is likely to have tracked water 108 thereon.

The video camera 128 is connected to the controller 122. The controller 122 can be operable to process an image that is output by the video camera 128 and detect the presence of moisture within the field of view 130 of the video camera 128 based on the image that is received from the video camera 128. The video camera 128 may be utilized to determine that tracked water 108 is on the floor 106 of the building 102 as opposed to utilizing the wet weather sensor 110. If the video camera 128 is used to discover the tracked water 108 on the floor 106 of the building 102, then the video camera 128 sends the moisture detection signal to the controller to engage the drying system 120. Regardless of whether the wet weather sensor 110 or the video camera 128 is utilized to determine whether tracked water 108 is on the floor 106 of the building 102, the drying system 120 will determine whether the images acquired by the video camera 128 indicate that the tracked water 108 has been sufficiently removed by the electric blower 126. If so, the drying system 120 will signal the warning devices 124 and the electric blower 126 to stop operating.

Figure 2:
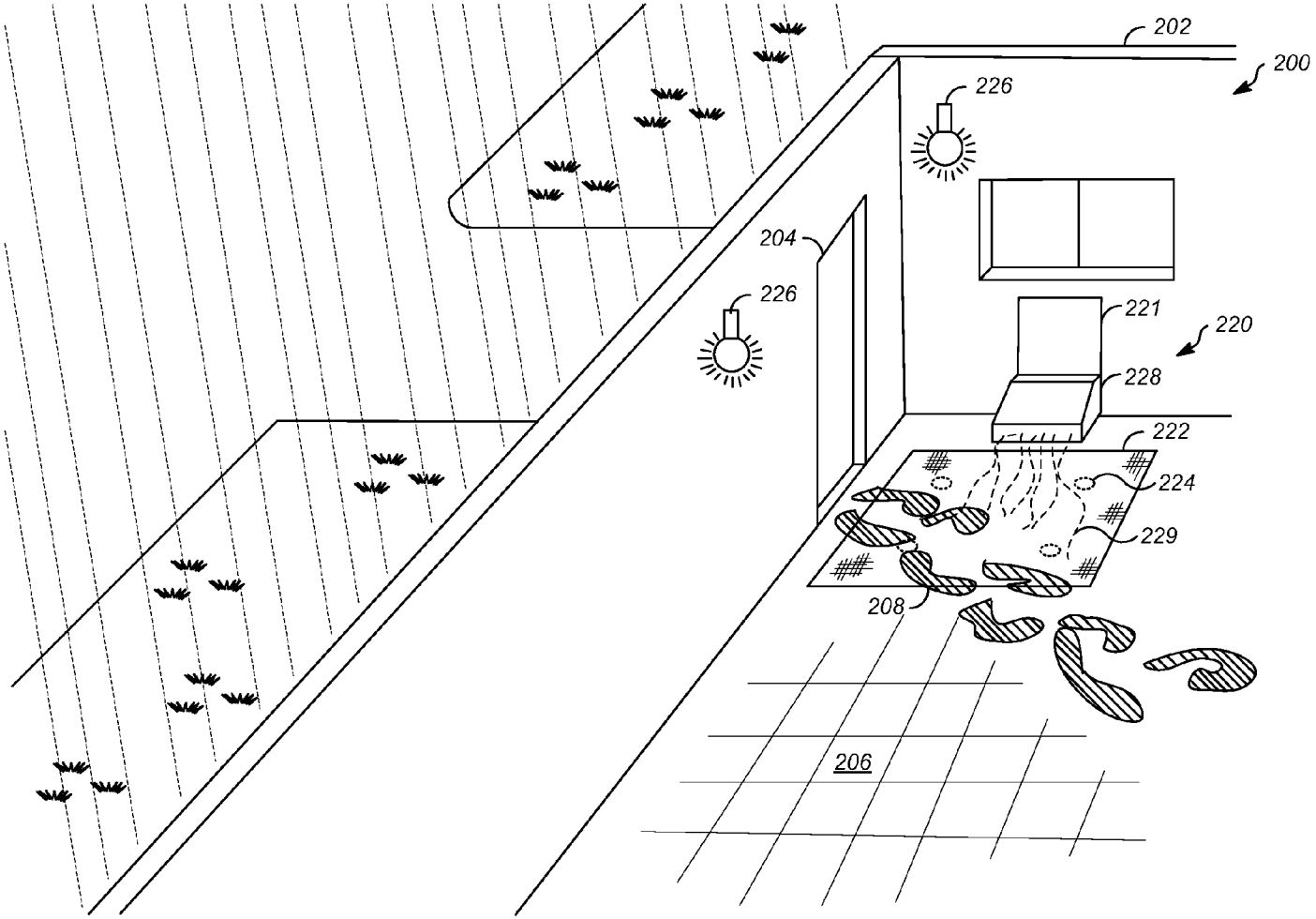
FIG. 2 is a perspective schematic diagram of a second example apparatus for automatically drying wet floors.

FIG. 2 shows a second example apparatus 200 in which a drying system 220 is installed in a building 202 having an entranceway 204 and a floor 206. In this embodiment, tracked water 208 is detected by one or more moisture sensors 224 that are built into a rug or a mat 222 that is positioned at a first location on the floor 206 near the entranceway 204 of the building 202. The moisture sensors 224 in the mat 222 signal the drying system 220 that moisture has been detected on the mat 222 and may lead to tracked water 208 beyond the mat 222 by transmitting a moisture detection signal from the mat 222 to a controller 221 of the drying system 220. In some implementations, the moisture detection signal can be wirelessly transmitted from the mat 222 to the controller 221, using well-known wireless communication protocols such as Wi-Fi or Bluetooth. In other implementations, a wired electrical connection can be made between the mat 222 and the controller 221. The controller 221 of the drying system 220 transmits a warning control signal to the warning devices 226 mounted on the inner walls of the building 202, similar to the warning devices 124 provided in the first example apparatus 100, to indicate possible hazardous conditions to pedestrians regarding moisture on the floor 206 of the building 202.

The drying system 220 also provides an operating signal to an electric blower 228 that is mounted on the inner wall and/or the floor 206 of the building 202, as similarly described in the first embodiment. The electric blower 228 may then begin drying the floor 206 by directing rapidly moving air 229 toward the first location, including the mat 222 and the floor 206 of the building 202. Again, the electric blower 228 may have a heating element (not shown) built therein such that the electric blower 228 may blow warm or hot air across the floor 206 of the building 202 so as to reduce the time associated with drying the floor 206. The moisture sensors 224 in the mat 222 can also detect the change in moisture resulting from the electric blower 228 drying the floor 206. When the moisture sensors 224 detect a change in the moisture thereby indicating that the floor 206 is drying, the moisture sensors 224 signal the drying system 220 to stop flashing the warning devices 226 and to stop the electric blower 228.

Figure 3:
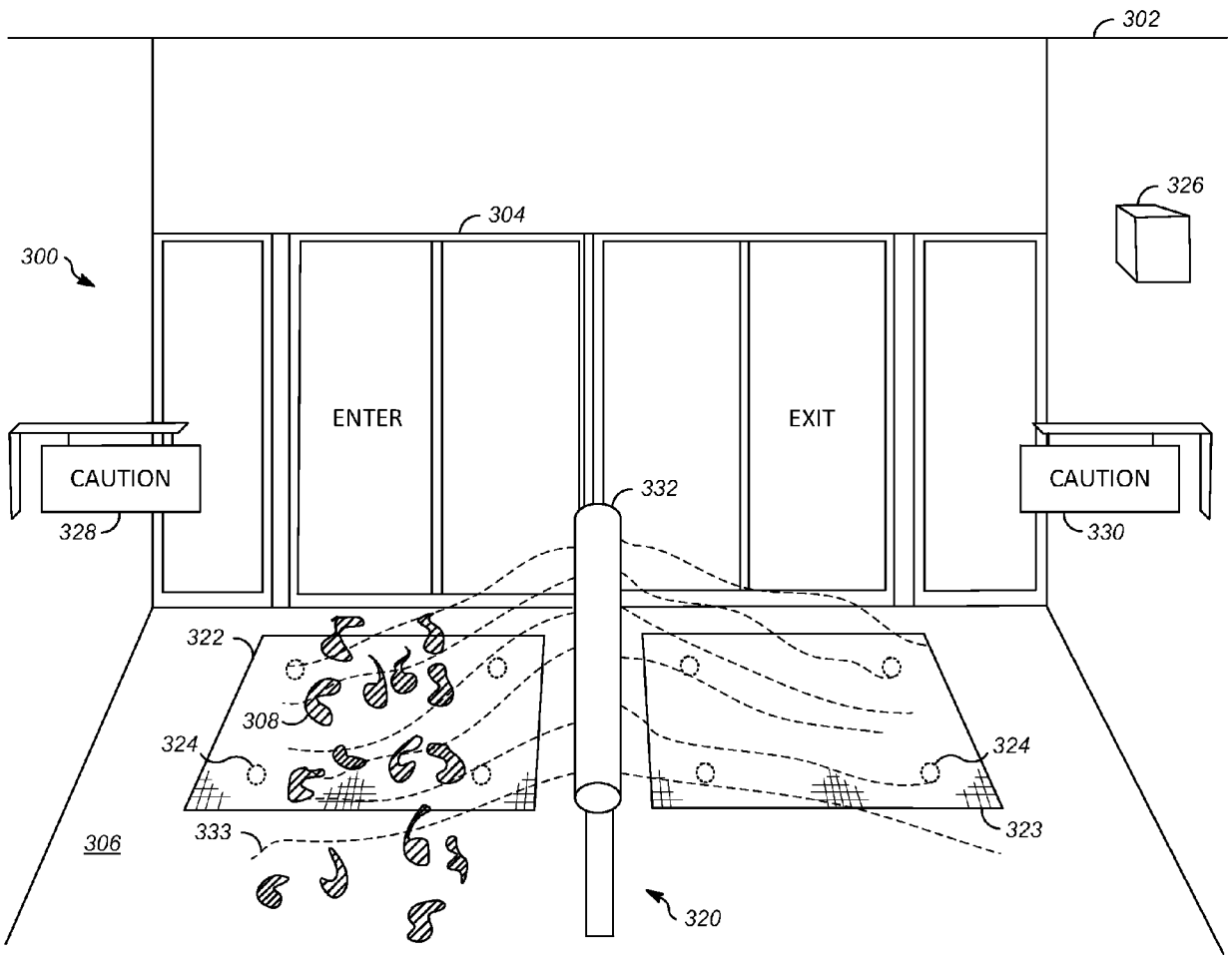
FIG. 3 is a perspective schematic diagram of a third example apparatus for automatically drying wet floors.

FIG. 3 shows a third example apparatus 300 in which a drying system 320 is installed in a building 302 having an entranceway 304 and a floor 306. Tracked water 308 on the floor 306 of the building 302 can be detected by at least one or more moisture sensors 324 mounted within rugs or mats 322, 323 disposed at a first location on the floor 306 of the building 302. Upon sensing moisture, the moisture sensors 324 provide a signal to a controller 326 indicating that moisture, which may lead to tracked water 308, is detected. The controller 326 may transmit a warning control signal to warning devices 328, 330, such as "caution" signs mounted to the inner walls of the building 302 to cause the warning devices 328, 330 to flash in an illuminating manner. The warning devices 328, 330 are to warn pedestrians of possible hazardous conditions caused by the tracked water 308 on the floor 306 of the building 302.

In addition, the controller 326 may transmit an operating signal to a drying device, such as an electric blower 332, to engage and begin drying the floor 306. The electric blower 332 may be mounted directly to and above the floor 306 of the building 302 adjacent to the rugs or mats 322, 323 so that the electric blower 332 may blow rapidly moving air 333 directly across the rugs or mats 322, 323. Again, the electric blower 332 may contain a heating element (not shown) built therein so that warm or hot air may be used to reduce the time associated with drying the rugs or mats 322, 323 on the floor 306 of the building 302. When the moisture sensors 324 indicate to the controller 326 that the floor 306 is sufficiently dry, the controller 326 may transmit signals to the warning devices 328, 330 to cause the warning devices 328, 330 to stop indicating hazardous conditions and cause the electric blower 332 to disengage and stop drying the floor 306 of the building 302.

Figure 4:
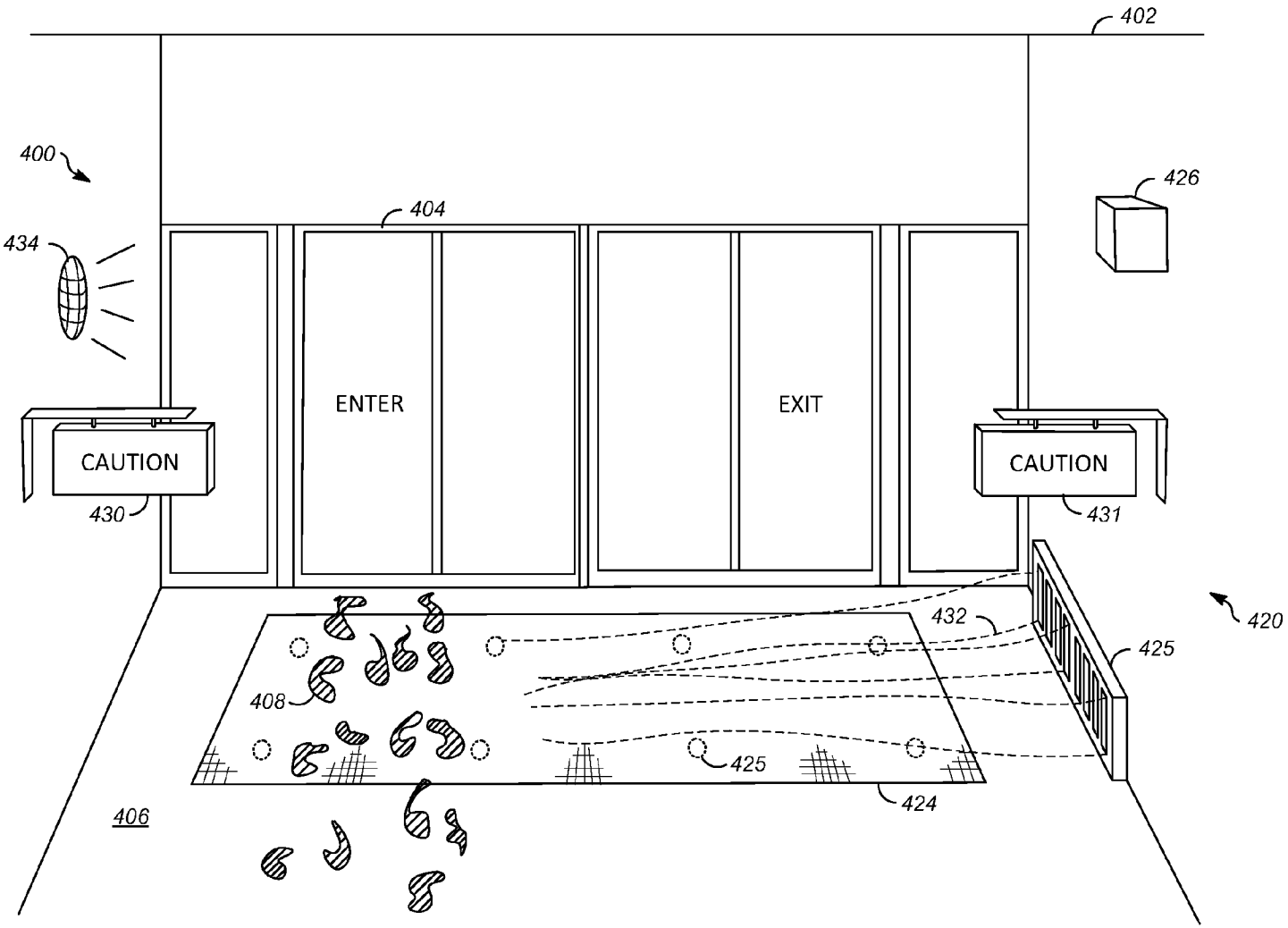
FIG. 4 is a perspective schematic diagram of a fourth example apparatus for automatically drying wet floors.

FIG. 4 shows a fourth example apparatus 400 in which a drying system 420 is installed in a building 402 having an entranceway 404 and a floor 406. Tracked water 408 can be detected by a rug or mat 424 on the floor 406 of the building 402 having one or more moisture sensors 425. The moisture sensors 412 may signal a controller 428 that moisture has been detected, whereupon the controller 428 may signal warning devices 430, 431, in this case, "caution" signs mounted on the inner walls of the building 402 which flash or illuminate to indicate to pedestrians a potentially hazardous condition on the floor 406 of the building 402.

The controller 428 can also signal a built-in electric blower (not shown) to begin blowing rapidly moving air 432 across the floor 406 of the building 402 to dry the tracked water 408 on the rug or mat 424 on the floor 406 of the building 402. Again, the electric blower 422 may have a heating element (not shown) built therein so that the electric blower 422 may blow warm or hot air across the floor 406 of the building 402 in order to reduce the amount of time required to dry the mat 424 and/or the floor 406. When the moisture sensors 412 indicate that the mat 424 and/or the floor 406 is sufficiently dry by signaling the controller 426, the controller 426 may signal the warning devices 430, 431 to stop indicating a hazardous condition exists and signal the built-in blower to stop blowing the rapidly moving air 432.

Audible warning devices 434 may be provided and can include a recording of a person offering a verbal warning regarding a possible wet floor or a particular warning sound, such as a low-level siren. In addition, the previous examples may be modified to include the audible warning devices 434 in addition to or in place of the warning devices, such as the warning lights and warning signs described above.

Aspects of the disclosed embodiments can include other techniques for drying floors in addition to or in place of fans or blowers, including forced heated air, automatic application of mechanical drying devices such as "squeegee" blades or infrared radiation. Aspects of the disclosed embodiments can activate the warning devices and drying devices on a timer circuit, wherein upon detection of a potential wet floor condition, the warning devices and the drying devices will operate for a predetermined amount of time. The timers could be tied in with the outdoor weather sensors such that the outdoor weather sensors could initiate the timers by providing a signal upon realizing wet conditions, or a user could manually engage the timer upon realizing wet weather conditions outdoors, such as rain, snow, and/or hail.

Figure 5:
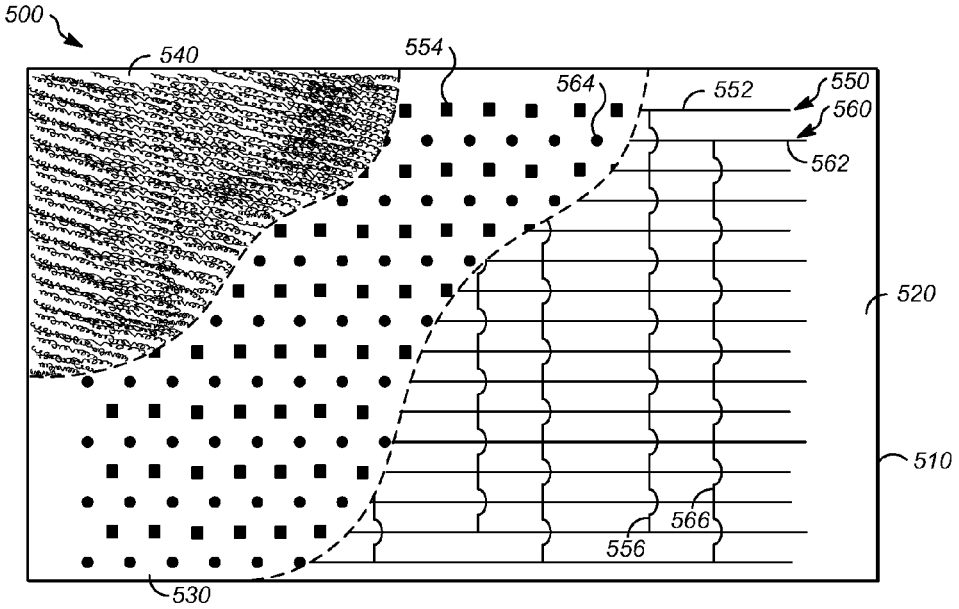
FIG. 5 is a top cutaway view showing a moisture detecting floor mat.
Figure 6:
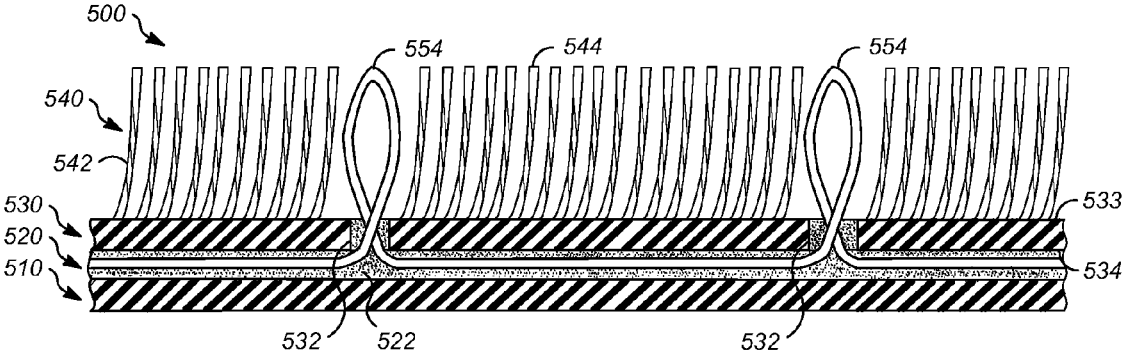
FIG. 6 is a side cross-section view of the moisture detecting floor mat.

FIGS. 5-6 show moisture detecting floor mat 500. The moisture detecting floor mat 500 can be used as a moisture detector in the examples described in connection with FIGS. 1-4. For instance, the moisture detecting floor mat 500 can be utilized in place of the mat 424 of FIG. 4. The moisture detecting floor mat 500 includes a base layer 510, an intermediate layer 520, a carpet backing layer 530, and a carpet layer 540. The moisture detecting floor mat 500 also includes a first electrode assembly 550 and a second electrode assembly 560. The first electrode assembly 550 includes a first conductor portion 552 and a plurality of first electrodes 554 that are connected to the first conductor portion 552. The second electrode assembly 560 is similar to the first electrode assembly 550 and includes a second conductor portion 562 and a plurality of second electrodes 564.

The base layer 510 and the carpet backing layer 530 are each formed from an impermeable and non-conductive material. An example of a suitable material is rubber. Other materials can be utilized. The base layer 510 can be substantially continuous without interruptions, holes, or other discontinuities. The carpet backing layer 530 includes a plurality of apertures 532. Each of the electrodes from the plurality of first electrodes 554 and each of the electrodes from the plurality of second electrodes 564 extends through a respective one of the apertures 532 such that the electrodes 554, 564 extend through the carpet backing layer 530. Thus, the electrodes from the plurality of first electrodes 554 and the electrodes from the plurality of second electrodes 564 are disposed within the carpet layer 540 among a plurality of carpet fibers 542 thereof, and the electrodes 554, 564 can extend from the carpet backing layer 530 to a carpet surface 544 that is defined by the carpet fibers 542 of the carpet layer 540.

The carpet backing layer 530 can define a top surface 533 that faces the carpet layer 540 and a bottom surface 534 that faces the intermediate layer 520. Within the intermediate layer 520, the first conductor portion 552 of the first electrode assembly 550 and the second conductor portion 562 of the second electrode assembly 560 are disposed between the base layer 510 and the carpet backing layer 530. The first conductor portion 552 and the second conductor portion 562 are electrically isolated from one another such that the first electrode assembly 550 and the second electrode assembly 560 are electrically isolated from one another within the intermediate layer 520. This can be accomplished by providing insulating material between portions of the first electrode assembly 550 and the second electrode assembly 560 that might otherwise come in contact, such as at redundant connections 556, 566 between portions of the first electrode assembly 550 and the second electrode assembly 560.

The intermediate layer 520 can be an adhesive layer, with the first conductor portion 552 of the first electrode assembly 550 and the second conductor portion 562 of the second electrode assembly 560 being embedded within an adhesive 522 within the intermediate layer 520. The adhesive 522 can secure the carpet backing layer 530 to the base layer 510, secure the first electrode assembly 550 and the second electrode assembly 560 in place, and prevent intrusion of water into the intermediate layer 520. Thus, water is prevented from contacting the first conductor portion 552 of the first electrode assembly 550 and the second conductor portion 562 of the second electrode assembly 560.

As best seen in FIG. 5, the plurality of first electrodes 554 and the plurality of second electrodes 564 can be disposed within the carpet layer 540 and an overlapping pattern, such as overlapping grids. As will be explained further herein, the first electrode assembly 550 and the second electrode assembly 560 are utilized to detect the presence of moisture in the carpet layer 540 by completion of an electrical circuit between the first electrode assembly 550 and the second electrode assembly 560 by way of a wetted area of the carpet layer that includes electrodes from each of the plurality of electrodes 554 and the plurality of second electrodes 564. Because the wetted portion of the carpet layer 540 will conduct electricity, completion of an electrical circuit that includes electrodes from the plurality of first electrodes 554, the plurality of second electrodes 564, and the wetted portion of the carpet signifies that the carpet layer 540 is moist, and thus completion of this electrical circuit can be used as a basis for outputting the moisture detection signal.

Figure 7:
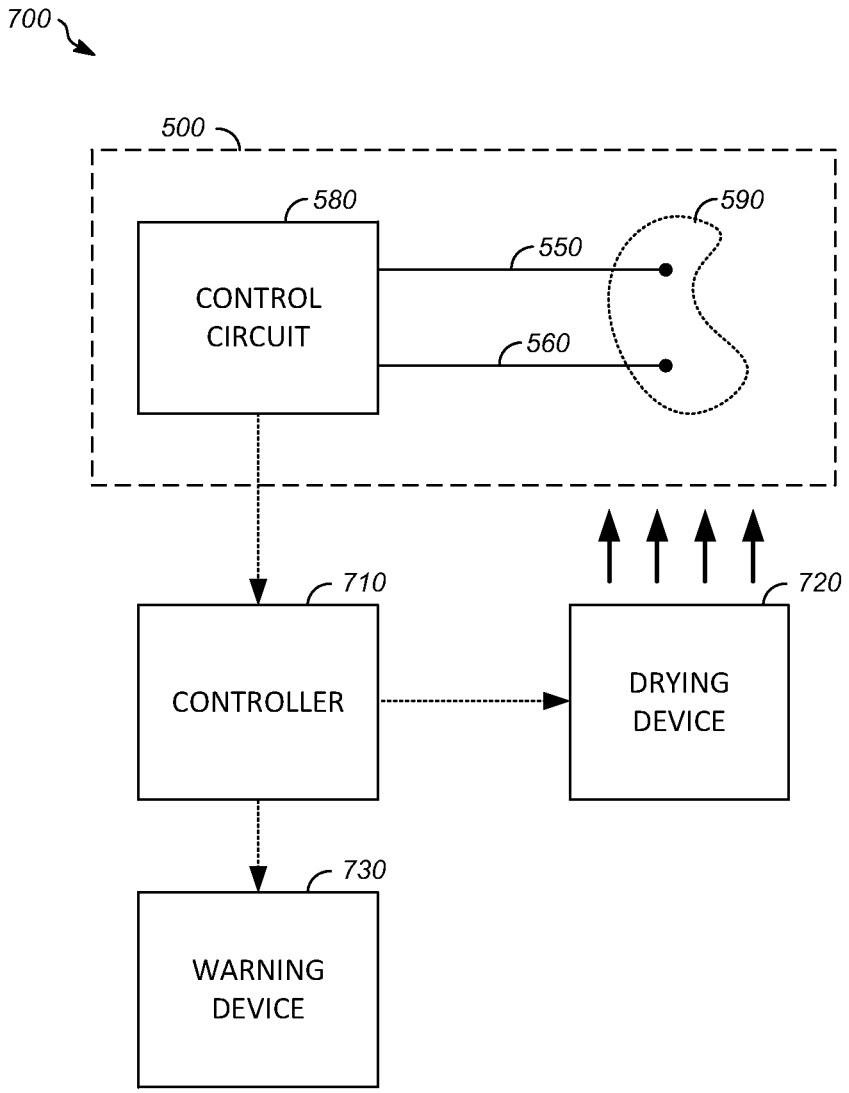
FIG. 7 is a block diagram of an apparatus for automatically drying wet floors including the moisture detecting floor mat.

FIG. 7 is a block diagram showing a system 700 that includes the moisture detecting floor mat 500 of FIGS. 5-6. In the system 700, the moisture detecting floor mat 500 utilizes a control circuit 580 to generate the moisture detection signal when the first electrode assembly 550 and the second electrode assembly 560 complete an electrical signal via a wetted area 590 of the carpet layer 540. The control circuit 580 can include a transmitter that is operable to wirelessly transmit the moisture detection signal to a controller 710, which is similar to the controllers described in connection with the examples of FIGS. 1-4.

Based on the moisture detection signal, the controller 710 determines whether to perform one or more actions, for example, by comparing the moisture detection signal to a predetermined condition. The predetermined condition can be presence or absence of the moisture detection signal, a time with respect to which the moisture detection signal has been present or absent or any other desired condition. Upon determining that the condition is satisfied, the one or more actions taken by the controller 710 can include transmitting an operating signal to a drying device 720, which is similar to the drying device described in connection with the examples of FIGS. 1-4. The operating signal can be transmitted from the controller to the drying device by either a wired electrical transmission or a wireless electrical transmission. The one or more actions that can be taken by the controller 710 also include transmitting a warning condition signal to a warning device 730, which is similar to the warning device as described in connection with the examples of FIGS. 1-4. The warning condition signal can be transmitted by wired or wireless electrical communication from the controller 710 to the warning device 730.

From the foregoing examples, it will be appreciate that the apparatuses described with connection to FIGS. 1-7 can be utilized in a method for automatically drying wet floors that includes detecting the presence of moisture by a moisture detector at a first location and transmitting a moisture detection signal from the moisture detector to a controller in response to detecting the presence of moisture at the first location. Such a method can also include outputting an operating signal from the controller to a blower based on the moisture detection signal if an operating condition is satisfied. The method includes operating the blower in response to the operating signal. Such a method can also include outputting a warning condition signal from the controller to a warning device based on the moisture detection signal if an operating condition is satisfied and operating the warning device in response to the warning condition signal. Such a method can also include detecting the moisture using a moisture detector as described in connection with the examples of FIGS. 1-7, such as the video camera 128 of FIG. 1, the wet weather sensor 110 of FIG. 1, the mat 222 of FIG. 2, the mats 322, 323 of FIG. 3, the mat 424 of FIG. 4, and the moisture detecting floor mat 500 of FIGS. 5-7.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for automatically drying wet floors, comprising:

a controller;

a floor mat having:

an first impermeable and nonconductive layer that has a top surface and a bottom surface, the first impermeable and nonconductive layer having a plurality of apertures formed therethrough such that each aperture extends from the bottom surface to the top surface, a first electrode assembly having a first conductor portion that is disposed adjacent to the bottom surface of the first impermeable and nonconductive layer, and a plurality of first electrodes that are electrically connected to the first conductor portion and extend through respective ones of the apertures formed in the first impermeable and nonconductive layer, a second electrode assembly having a second conductor portion that is disposed adjacent to the bottom surface of the first impermeable and nonconductive layer, and a plurality of second electrodes that are electrically connected to the second conductor portion and extend through respective ones of the apertures formed in the first impermeable and nonconductive layer, and a control circuit for transmitting a moisture detection signal to the controller by wireless communication with the controller in response to a completed electrical circuit that includes electrical communication between the first electrode assembly and the second electrode assembly; and a blower that is operative to turn on and off for drying the wet floors by directing moving air toward the floor mat in response to an operating signal from the controller, wherein the controller outputs the operating signal to the blower based on the moisture detection signal.

2. The apparatus of claim 1, further comprising a warning indicator that is operative to turn on and off for warning pedestrians in response to a warning control signal from the controller.

3. An apparatus for automatically drying wet floors, comprising:

a controller;

a moisture detector that is operable to detect the presence of moisture at a first location and transmit a moisture detection signal to the controller in response to detecting the presence of moisture at the first location, wherein the moisture detector includes a floor mat located at the first location, the floor mat having:

a carpet layer that includes carpet fibers that define a carpet surface, an impermeable and nonconductive carpet backing layer that has a top surface and a bottom surface, the top surface of the carpet backing layer having the carpet fibers affixed thereto, and the carpet backing layer having a plurality of apertures formed therethrough such that each aperture extends from the bottom surface to the top surface, a first electrode assembly having a first conductor portion that is disposed adjacent to the bottom surface of the carpet backing layer and a plurality of first electrodes that are electrically connected to the first conductor portion, extend through respective ones of the apertures formed in the carpet backing layer, and are disposed within the carpet layer, and a second electrode assembly having a second conductor portion that is disposed adjacent to the bottom surface of the carpet backing layer and a plurality of second electrodes that are electrically connected to the second conductor portion, extend through respective ones of the apertures formed in the carpet backing layer, and are disposed within the carpet layer, wherein the moisture detector outputs the moisture detection signal in response to a completed electrical circuit that includes electrical communication between the first electrode assembly and the second electrode assembly via a wetted portion of the carpet layer; and a blower that is operative to turn on and off for drying the wet floors by directing moving air toward the first location in response to an operating signal from the controller, wherein the controller outputs the operating signal to the blower based on the moisture detection signal.

4. The apparatus of claim 3, wherein the floor mat includes an impermeable and nonconductive base layer, wherein the first conductor portion of the first electrode assembly and the second conductor portion of the second electrode assembly are disposed between the carpet backing layer and the base layer.

5. The apparatus of claim 4, wherein the floor mat includes an intermediate layer that is disposed between the carpet backing layer and the base layer, wherein the first conductor portion of the first electrode assembly and the second conductor portion of the second electrode assembly are disposed in the intermediate layer, and the first conductor portion of the first electrode assembly and the second conductor portion of the second electrode assembly are electrically isolated from one another within the intermediate layer.

6. The apparatus of claim 3, further comprising a warning indicator that is operative to turn on and off for warning pedestrians in response to a warning control signal from the controller.

7. The apparatus of claim 6, wherein the warning indicator includes an illuminated indicator.

8. The apparatus of claim 6, wherein the warning indicator includes an audio output device for generating an audible warning.

9. The apparatus of claim 3, wherein the controller is in wireless electrical communication with the moisture detector for wireless receipt of the moisture detection signal.

10. An apparatus for automatically drying wet floors, comprising:

a controller;

a moisture detector that is operable to detect the presence of moisture at a first location and transmit a moisture detection signal to the controller in response to detecting the presence of moisture at the first location, wherein the moisture detector includes a floor mat located at the first location, the floor mat having:

a carpet layer that includes carpet fibers that define a carpet surface, an impermeable and nonconductive carpet backing layer that has a top surface and a bottom surface, the top surface of the carpet backing layer having the carpet fibers affixed thereto, a first electrode assembly having a first conductor portion that is disposed adjacent to the bottom surface of the carpet backing layer and a plurality of first electrodes that are electrically connected to the first conductor portion, extend through the carpet backing layer, and are disposed within the carpet layer, a second electrode assembly having a second conductor portion that is disposed adjacent to the bottom surface of the carpet backing layer and a plurality of second electrodes that are electrically connected to the second conductor portion, extend through the carpet backing layer, and are disposed within the carpet layer, an impermeable and nonconductive base layer, wherein the first conductor portion of the first electrode assembly and the second conductor portion of the second electrode assembly are disposed between the carpet backing layer and the base layer, and an adhesive layer that is disposed between the carpet backing layer and the base layer, wherein the first conductor portion of the first electrode assembly and the second conductor portion of the second electrode assembly are embedded in the adhesive layer, and the adhesive layer prevents water from coming into contact with the first conductor portion of the first electrode assembly and the second conductor portion of the second electrode assembly, wherein the moisture detector outputs the moisture detection signal in response to a completed electrical circuit that includes electrical communication between the first electrode assembly and the second electrode assembly via a wetted portion of the carpet layer; and a blower that is operative to turn on and off for drying the wet floors by directing moving air toward the first location in response to an operating signal from the controller, wherein the controller outputs the operating signal to the blower based on the moisture detection signal.

* * * * *